United States Patent [19]

Tsai

[11] 4,277,854

[45] Jul. 14, 1981

[54] WATER-SAVING TOILET BOWL

[76] Inventor: Kuo L. Tsai, 5, Lane 59, Chad Chou St., Taipei, Taiwan

[21] Appl. No.: 97,442

[22] Filed: Nov. 26, 1979

[51] Int. Cl.[3] ..... E03D 11/00

[52] U.S. Cl. ..... 4/420; 4/415; 4/428; 4/661

[58] Field of Search ..... 4/415, 420, 428, 661

[56] References Cited

U.S. PATENT DOCUMENTS

| | | | |
|---|---|---|---|
| 1,271,026 | 7/1918 | Freck | 4/428 |
| 3,334,358 | 8/1967 | McPherson | 4/420 |
| 3,538,518 | 11/1970 | Helke et al. | 4/420 X |
| 3,723,998 | 4/1973 | Wahn | 4/415 |
| 4,050,101 | 9/1977 | Logue | 4/415 X |

*Primary Examiner*—Henry K. Artis

*Attorney, Agent, or Firm*—LeBlanc, Nolan, Shur & Nies

[57] ABSTRACT

The provision of a flush guiding means at a position with respect to main flush inlet to thereby constitute a very strong and swift correlated flushing action to readily remove the waste out of the bowl with a minimum amount of water and silent flushing operation.

6 Claims, 10 Drawing Figures

WATER-SAVING TOILET BOWL

BACKGROUND OF THE INVENTION

The main flush inlet of the conventional toilet bowl is small and is rectangular in cross section, and is generally vertical. Therefore, the amount of water needed to flush it is comparatively small and weak, and since the water flushes along the rear wall of the toilet bowl without having any guiding means to direct the flush-water into the toilet bowl the resistance of the wall often results in reducing the effect of flushing. Furthermore, since the secondary flush inlets of the conventional toilet bowl are many in number and are constructed in such a way that the secondary flush enters in more than one direction simultaneously with the main flush, the secondary flush only reduces the effect of the main flush. In addition, the conventional toilet bowls have the drawback that at the beginning of the flush, the waste is not immediately removed and requires additional water to flush it away and causes a lot of noise. Although, several types of silent operation of the toilet bowl have been proposed, most of them are not accepted to commercially, since a great deal of water i.e. 20 liters, is particularly required.

SUMMARY OF THE INVENTION

An object of the present invention is to provide a flush guiding means with an unique configuration at a location with respect to the main flush inlet and making at least one of water flushes to initiate a strong push-action forward and downward relative to the center of the smaller whirlpool with swift movement so as to readily remove the waste away the bowl at maximum speed operation with a very limited quantity of water.

Another object of the present invention is to provide a water-saving and silent operation toilet bowl for either siphonic or blow out action type wherein a high efficient flushing operation is accomplished with a very limited amount of water.

A further object of the present invention is the provision of a water-saving toilet bowl wherein the streams of water flush are submerged and directed into the reservoir so that an optimum quality of silent operation is thus obtained.

BRIEF DESCRIPTION OF THE DRAWINGS

The above and other objects, advantages, and features of the present invention will become more readily understood from a consideration of the following detailed description and accompanying drawings, in which.

DETAILED DESCRIPTION OF THE DRAWINGS

Figure 1:
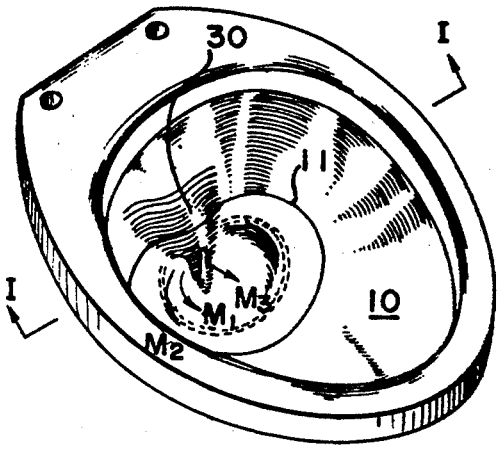
FIG. 1 is a perspective view of a preferred embodiment of the water-saving toilet bowl of the present invention.

FIGS. 1 to 5 depict the first embodiment of water-saving and silent operation toilet bowl of the present invention. As show in FIGS. 3 and 4, a water entrance 20 is provided at the rear of the water-saving bowl 10, and a reservoir 11 is formed within said bowl 10. In this preferable embodiment, two main flush inlets 211 and 212 are intentionally provided at the rear inner wall of said bowl 10 in the height below the water level of the reservoir 11 and between both inlets there is a provision of a flush guiding means 30 which is smoothly and integrally formed with the inner wall of said bowl in an outward convex portion with respect to the inner wall of said bowl and longitudinally and gradually extending from the vicinity of both inlets 211 and 212 to the upper wall of said bowl 10. This is an important feature of the present invention.

The first main flush inlet 211 and second main flush inlet 212 are fluidly communicated with the water entrance 20 through water flush passage 21. Above the reservoir 11, a front pan 12 is smoothly declined and extends from the upper wall of said bowl into the surface of water of the reservoir 11 with the free end 121 thereof below the water level.

Figure 2:
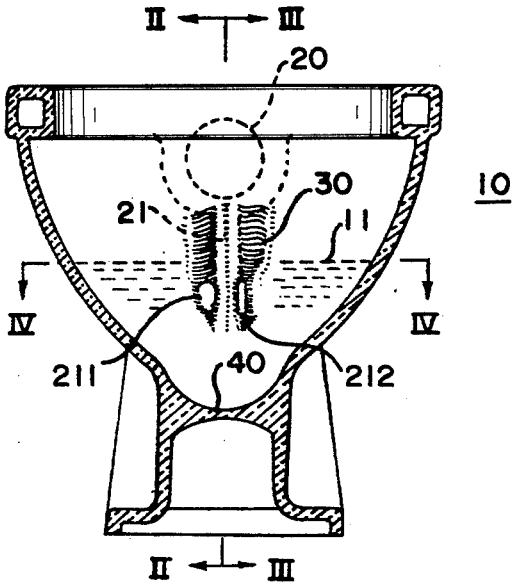
FIG. 2 is a vertical section of a first embodiment of the present invention, taken on the lines I—I of FIG. 1.
Figure 3:
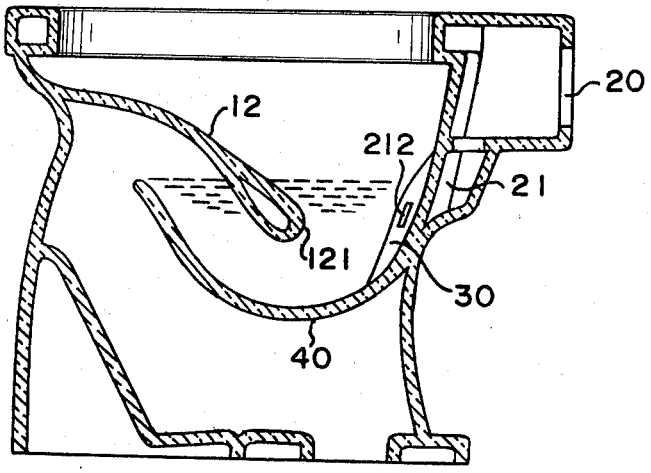
FIG. 3 is a vertical section of the first embodiment of the present invention, taken on lines II—II of FIG. 2, showing a cross section of water inlet passage and the configuration of first flush inlet.
Figure 4:
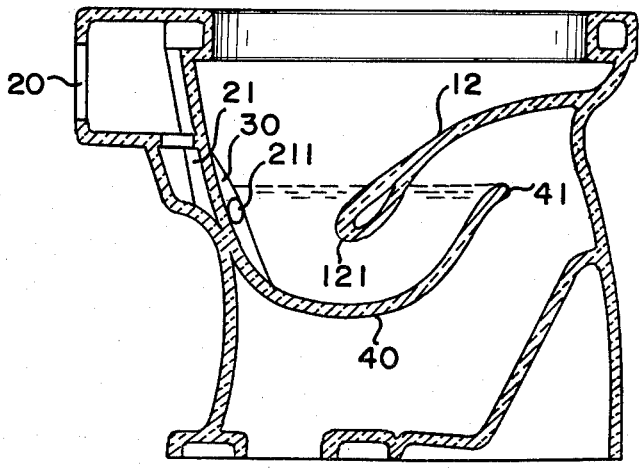
FIG. 4 is a vertical section of the first embodiment of the present invention, taken on lines III—III of FIG. 2, showing a cross section of water inlet passage and the configuration of the second flush inlet.
Figure 5A:
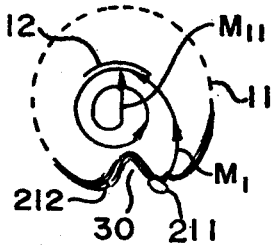
FIG. 5 A-5C are schematical top views taken on lines IV—IV of FIG. 2, showing steps of a correlated flush action of the first and second main flush during flushing operation.
Figure 5B:
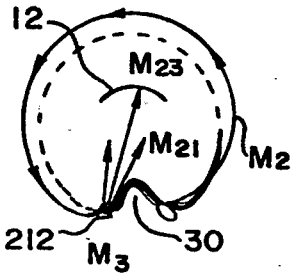
Figure 5C:
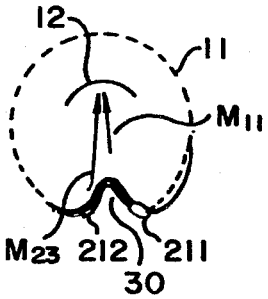

Referring to FIGS. 1 and 2, in this embodiment the first main flush inlet 211 is located at the left and the second main flush inlet 212 at the right. The configuration of the first main flush inlet 211 is preferably a larger and approximately round hole while the second main flush inlet 212 is preferably a smaller and approximately rectangular or elliptic hole. The orientation, location and configuration of the first flush inlet 211 is provided at a such mutual-relationship with respect to the flush guiding means, in general, to adaptly conduct two kinds of flush streams in a form of M1 and M2. As shown in FIGS. 5A to 5C, stream M1 is of a leftward stream going around the lower inner wall of the bowl and under the resistance effect of the free end 121 of the front pan 12 and the flush guiding means 30 to constitute a smaller whirlpool M11 (as shown in FIG. 5A) in a forward and downward direction toward the weir 41 of guiding trough 40, while the stream M2 is performing a counterclockwise larger whirlpool around the upper inner wall portion of the bowl 10, i.e. going up to the water level of the reservoir 11, due to the configuration of the inner wall of the bowl 10, so as to conduct a larger circle whirlpool M2.

As soon as whirlpool M2 reaches the vicinity area of the left edge of flush guiding means 30, the whirlpool M2 is forced to change and turn its direction into a stream M21, as indicated.

At this instant, the second main inlet 212 also initiates a straight and downward pushing flush M3 which is going to mix with the flush M21. Under the effect of a correlated action of both streams M21 and M3, a strong forward and downward pushing flush M23 is thus obtained. It will be clearly understood that the flush M2 is going to be accelerated in its centripetal movement around the smooth inner upper wall of the bowl at a maximum velocity when the flush M2 reaches the right side edge of convex portion of the flush guiding means 30.

In this manner, the flush M23 provides a sufficient strong action to push the smaller whirlpool M11 initiated by flush M1 in a direction of being straight and downward toward the lower portion of the free end 121 of the front pan 12 and thus the resultant flush M23 and M11 can readily flush the waste away from the bowl 10 along the guiding trough 40, effectively preventing the lingering of the waste under very limited amount of water, i.e. no more than 6 liters.

It will be noted that in case the reservoir 11 is of a high water level, as shown in this preferable embodiment, larger whirlpool M2 can reach the upper wall portion of the bowl to readily wash out any waste abutted thereon so that the secondary flush is conventional and can be thus omitted.

Figure 6:
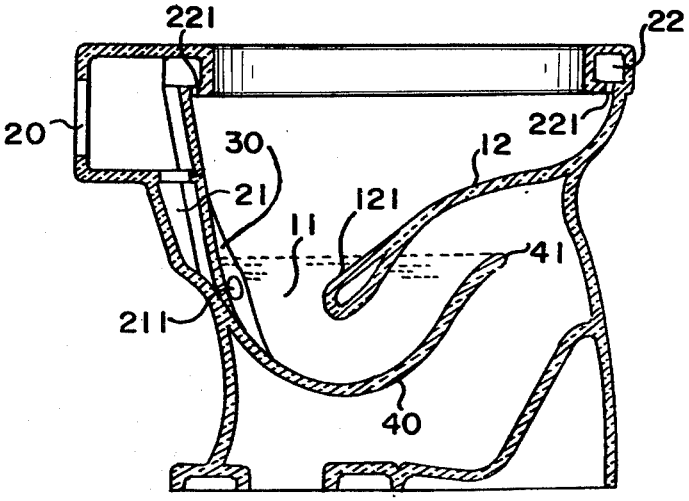
FIG. 6 is a vertical section of the second embodiment of the present invention, taken from the same position of FIG. 3, showing a plurality of secondary flush inlets additionally provided around the top rim of the toilet bowl.

Referring to FIG. 6, there is shown the second embodiment of water-saving toilet bowl of the present invention. In this embodiment, the water level of the reservoir 11 is substantially lower than that of the first embodiment (see FIG. 3). In order to completely effect the flush action, a plurality of secondary flush inlets 221—221 is provided around the rim of the top toilet bowl. The secondary flush inlets 221—221 are fluidly communicated with the flush water entrance 20 to receive flush-water therefrom through a secondary flush passage 22. The other components perform the same function as described above, and the related illustration therefore is omitted.

Figure 7:
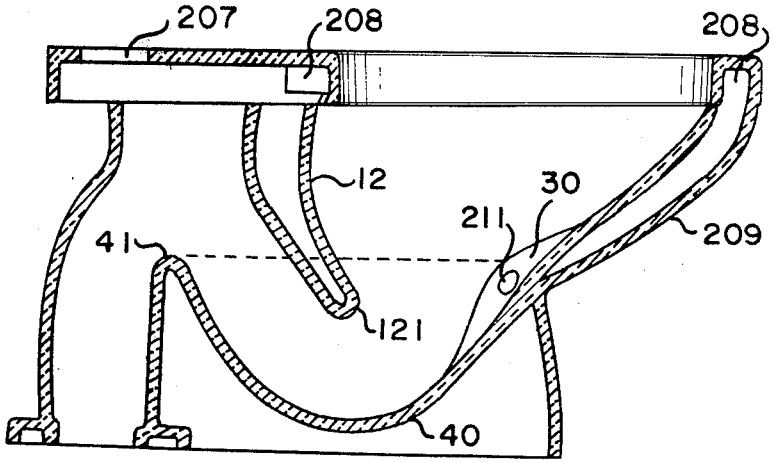
FIG. 7 is a vertical section of the third embodiment of the present invention, taken from one side thereof.

FIG. 7 depicts the third embodiment of water-saving and silent operation toilet bowl of the present invention. In this embodiment, the water entrance 207 is provided at the rear of the bowl, and the first and second main flush inlets are located at the front portion of the bowl, as indicated in the drawing, which is connected to the water entrance 207 through water passage 208 and tunnel 209 to perform the same effective flushing operation as above.

It is to be understood that the main flush inlets of the foregoing descriptions are positioned beneath the water level of the reservoir 11 so that duing flushing operation an optimum quality of silent operation is obtained.

As we know, the main flush in the foregoing descriptions is conducted by two types of main flush inlets positioned beneath the water level of the reservoir. However, if one of main flush inlets is omitted, and the remaining main flush inlet should be in a type of being capable of initiating a main flush in a form of a strong downward and forward stream in a correlated action with a larger whirlpool coming from secondary flush inlet to readily push the waste away from the bowl. In this way, the secondary flush inlets should be oriented in the same direction so as to initiate a larger whirlpool along an inside surface of the bowl. According to my long-term experiment, in this embodiment, I found seven liters of flush water is required to accomplish the same function as above.

Furthermore, if we search only for the purpose of saving water and abandon the advantage of silent operation for toilet bowl, the location of main flush inlets provided in the foregoing embodiments may change their position in the height above the water surface of the reservoir 11.

According to my experimatation, their flushing operation and the amount of flush water required make no difference at all. Therefore, it is obvious that these changes in the arrangement of the mounting position of the main flush inlets would deem to be in the scope and spirit of the present invention.

Figure 8:
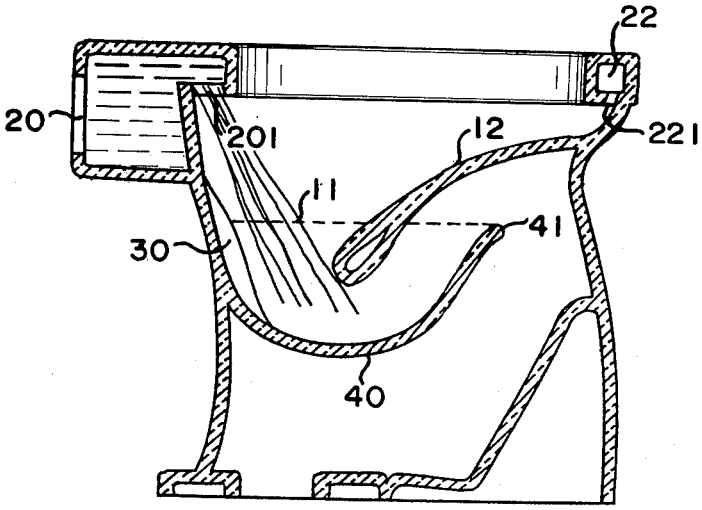
FIG. 8 is a vertical section of the fourth embodiment of the present invention, taken from one side thereof, showing a main flush inlet mounted above the water surface of the reservoir.

For the purpose of clarity of illustration of the present invention described above, there is the provision of fourth embodiment, as shown in FIG. 8. Referring to the drawing, the main flush inlet 201 is fluidly communicated with the water entrance 20 through the flush water passage 22. Said main flush inlet 20 as shown is oriented at an angle with respect to the upper wall of said bowl to conduct a downward flush water toward near the center of the reservoir 11, which does not contact the wall surface of said bowl adjacent said flush water inlet means and said flush water guiding means, and then constituting a straight downward flush action to readily flush the waste away from the bowl. In this embodiment, a plurality of secondary flush inlets 221 are defined in the secondary flush passage 22, and declined in the same direction to initiate a larger whirlpool along an inside surface of the bowl, as above.

While I have described several embodiments and modifications of the present invention. It is apparent that certain changes, omissions and substitutions of the flush water guiding means together with main flush inlet of the present invention may be made therein without departing either from the spirit of the invention or the scope of the appended claims.

I claim:

1. A water saving toilet bowl comprising a bowl defining a water reservoir, flush water guiding means comprising an outwardly projecting convex formation within the bowl smoothly and integrally merging with the inner surface of said bowl and longitudinally extending downwardly into the reservoir from the upper portion of the inner wall surface of the bowl, first and second main flush inlets connected by an intake passage in the bowl to a flush water entrance means and opening into said bowl at opposite sides of said convex guiding means, a front pan extending from the upper inner wall of said bowl opposite said inlets away from said wall and down into said reservoir with a free end presented toward said main flush inlets, said first main flush inlet being so oriented with respect to the bowl wall as to move flush water toward said front pan in streams of both a smaller circle whirlpool around the lower portion of the bowl wall and a larger circle whirlpool around the upper portion of the bowl wall that is deflected by said guiding means to provide a stream toward the interior of the reservoir, and said second main flush inlet means being so oriented with respect to the bowl wall as to provide a relatively straight downward stream of flush water to mix with water from said other streams and effectively flush waste away from said bowl wall.

2. A water-saving toilet bowl according to claim 1 wherein said main flush inlets are positioned below the water level of said reservoir.

3. A water-saving toilet bowl according to claim 1 wherein said main flush inlets are provided at the front of said bowl.

4. A water-saving toilet bowl as defined in claim 1, wherein there is a secondary flush passage around the upper end of said bowl in communication with said entrance means, and said secondary flush passage has a plurality of secondary flush inlets oriented to produce within the bowl a whirlpool of flush water along the inner surface of said bowl merging with said main inlet flush water.

5. A water-saving toilet bowl as defined in claim 1 wherein said first main flush inlet means is an approximately round opening while the second main flush inlet means is a smaller approximately rectangular or elliptical opening.

6. A water saving toilet bowl comprising a bowl defining a water reservoir, flush water guiding means comprising an outwardly projecting integral convex formation within the bowl smoothly and integrally merging with the inner surface of said bowl, and longitudinally extending downwardly from the upper portion of the inner wall surface of the bowl, flush water inlet means in the upper part of said bowl and comprising a main flush water inlet oriented at an angle with respect to the upper part of the bowl wall to direct flush water toward the center of the bowl in a stream that has no substantial contact with the bowl wall surface adjacent said inlet means and adjacent said guiding means, secondary flush means surrounding the upper part of said bowl in fluid communication with said inlet means and comprising a plurality of secondary flush water inlet openings oriented to produce a whirlpool along the inner surface of the bowl wall directed to mix with said main flush in the reservoir.

* * * * *